US005623114A

United States Patent [19]

Soper

[11] Patent Number: 5,623,114

[45] Date of Patent: Apr. 22, 1997

[54] SELECTABLE FIRE TRIGGER MECHANISM

[76] Inventor: Terry A. Soper, 650 Ritter Rd., Las Cruces, N.M. 88005

[21] Appl. No.: 397,776

[22] Filed: Mar. 3, 1995

[51] Int. Cl.[6] ..... F41A 19/46

[52] U.S. Cl. ..... 89/141; 89/142

[58] Field of Search ..... 42/69.03; 89/140, 89/141, 142

[56] References Cited

U.S. PATENT DOCUMENTS

| | | | |
|---|---|---|---|
| 2,367,280 | 1/1945 | Hyde | 89/140 |
| 2,512,638 | 6/1950 | Gaidos | 89/140 |
| 2,533,283 | 12/1950 | Pierce | 89/142 |
| 2,716,923 | 9/1955 | Gaidos | 89/140 |
| 3,290,993 | 12/1966 | Irusta | 89/140 |
| 3,446,114 | 5/1969 | Ketterer | 89/140 |
| 4,937,964 | 7/1990 | Crandell | 42/69.03 |
| 5,115,588 | 5/1992 | Bronsart et al. | 42/69.02 |
| 5,187,312 | 2/1993 | Osborne | 42/69.01 |

FOREIGN PATENT DOCUMENTS

| | | | |
|---|---|---|---|
| 410553 | 4/1945 | Italy | 89/140 |
| 17809 | of 1897 | United Kingdom | 89/140 |
| 643209 | 9/1950 | United Kingdom | 89/140 |
| 693333 | 6/1953 | United Kingdom | 89/140 |
| 748828 | 5/1956 | United Kingdom | 89/140 |

OTHER PUBLICATIONS

McLoughlin, Chris, "U.S. Military's Advanced Combat Rifle", *Special Weapons* vol. 10, pp. 54–59, 1993.

"Assault Rifles," *Guns and Ammo Action Series* vol. 10, #2, pp. 52–61, pp. 29, 41, 69.

"Functions of Stock M–16", *Department of Army Technical Manual,* pp. 18–28.

"Functional Theory Of Three–Round Burst Control", *U.S. Marine Corps Technical Manual,* Section 3, pp. 76–81.

"Long, Duncan, The AR–15/M–16", *A Practical Guide,* pp. 47–49, p. 64.

*Primary Examiner*—Stephen C. Bentley

*Attorney, Agent, or Firm*—Jeffrey D. Myers; Donovan F. Duggan

[57] ABSTRACT

An improved trigger mechanism for weapons having full automatic fire capability. Exertion of a first predetermined trigger pressure enables the disconnector to engage the hammer in a semi-automatic fire mode. Exertion of a second, greater trigger pressure disables the disconnector, enabling a full automatic mode of fire.

5 Claims, 6 Drawing Sheets

SELECTABLE FIRE TRIGGER MECHANISM

BACKGROUND OF THE INVENTION

1. Field of the Invention (Technical Field)

This invention generally relates to firearms, and specifically to an improved fire control trigger mechanism for machine guns and methods of making and using such mechanism.

2. Background Art

The only trigger assemblies in current production and use for M-16 rifles are the M-16A1 lever-selected mechanism ("Safe-Semi-Auto") and the M-16A2 three-round burst mechanism. A four position selector/trigger assembly exists which combines "safe," "semi," "burst" and "auto" modes, but is only in very limited production.

The M-16A2 burst mechanism comprises a ratchet-and-pawl mechanism which limits the full automatic mode of fire to a three-round maximum thereby requiring trigger release and pull to initiate another three-round burst. The three-round burst mechanism has been criticized by some because it does not reset if less than three rounds are fired. This renders the subsequent burst either one, two or three rounds. Further, trigger pull varies at each point of the burst cycle; unpopularity of the burst mode of fire has resulted in deliberate disablement of the ratchet-and-pawl mechanism by troops in the field.

The Steyr-Aug machine gun does control selection of rate of fire with the trigger, but its design could not be incorporated into the M-16 without totally redesigning the M-16 rifle.

U.S. Pat. No. 2,716,923, to Gaidos, entitled "Firing Mechanism for a Rifle," issued Sep. 6, 1955, perhaps most pertinently, provides semi or full automatic fire modes based upon trigger pull alone. However, Gaidos requires an extremely complex trigger and sear mechanism not adaptable to modern M-16 use. Similarly, U.S. Pat. No. 3,290,993, to Irusta, entitled "Release Mechanism for Automatic Firearms," issued Dec. 13, 1966, discloses selective finger-engaging trigger portions enabling either semi-automatic or full automatic fire. U.S. Pat. No. 2,533,283, to Pierce, entitled "Trigger Mechanism," issued Dec. 12, 1950, discloses full automatic to semi-automatic fire in the obsolete Browning Automatic Rifle (M1918) by a selective fire lever. U.S. Pat. No. 2,512,638, also to Gaidos, entitled "Fire Control Selector for Automatic Firearms," issued Jun. 27, 1950, also discloses a selector lever for selecting either semi-automatic or full automatic fire.

U.S. Pat. No. 5,115,588, to Bronsart, et al., entitled "Trigger Mechanism for Firearms," issued May 26, 1992, discloses a trigger mechanism for bolt action pistols enabling an adjustable sear engagement. U.S. Pat. No. 2,367,280, to Hyde, entitled "Control Means," issued Jan. 16, 1945, discloses a trigger-actuated mechanism for controlling the operation of a semi-automatic rifle to single shot operation. U.S. Pat. No. 3,446,114, to Ketterer, entitled "Trigger Mechanism for Automatic Firearms," issued May 27, 1969, discloses a mechanism for converting semi-automatic fire to full automatic fire, or from closed bolt firing operation to open bolt firing operation.

U.S. Pat. No. 4,937,964, to Crandall, entitled "Two-Stage Triggered Adapter," issued Jul. 3, 1990, and U.S. Pat. No. 5,187,312, to Osborne, entitled "Two Stage Trigger Assembly," issued Feb. 16, 1993, both relate to trigger assemblies providing triggers with two distinct trigger "pulls," thereby indicating imminence of weapon discharge. No functional change in operation of the weapons is imparted by these mechanisms.

It seems clear that the prior art lacks teachings of a simple trigger mechanism specifically designed to alter rate of fire in M-16s and other weapons having a full automatic rate of fire by trigger pressure alone.

SUMMARY OF THE INVENTION (DISCLOSURE OF THE INVENTION)

The present invention is of a method of using a selective fire trigger mechanism in a weapon comprising a trigger and a disconnector, the method comprising: installing the trigger mechanism in a weapon capable of full automatic fire; selecting the full automatic fire mode; firing the weapon in a semi-automatic mode by exerting a first predetermined trigger pressure; and firing the weapon in a full automatic mode by exerting a second predetermined trigger pressure. In the preferred embodiment, the trigger mechanism is installed in an M-16A1 or M-16A2 rifle, the first predetermined trigger pressure is less than the second predetermined trigger pressure, exerting the first predetermined pressure enables the disconnector to engage a hammer, and exerting the second predetermined pressure disables the disconnector.

The present invention is also of a method of making a selective fire trigger mechanism, the method comprising: modifying a trigger by rotatably mounting an end of a link in the trigger; modifying a disconnector by shortening the disconnector; and coaxially assembling the trigger and disconnector by positioning an other end of the link on the disconnector. In the preferred embodiment, a recess is provided in the trigger, an extension is provided on the disconnector, and the other end of the link is positioned on the extension of the disconnector.

The present invention is further of a selective fire trigger apparatus for a full automatic weapon comprising: a trigger comprising a recess and a rotatably mounted link at an end thereof; and a disconnector comprising an extension at one end thereof, the link engaging the extension; wherein exertion of a first predetermined pressure on the trigger enables semi-automatic fire from the weapon, while exertion of a second predetermined pressure on the trigger enables full automatic fire of the weapon. In the preferred embodiment, the recess enables non-engagement of a selective rate-of-fire cam on the weapon, the link engages the selective rate-of-fire cam, exertion of the first predetermined trigger pressure enables the disconnector to engage a hammer on the weapon thereby enabling semi-automatic fire, and exertion of the second predetermined trigger pressure disables the disconnector thereby enabling full automatic fire.

A primary object of the invention is the provision of a simple trigger mechanism for providing selective fire rates by trigger manipulation alone.

Another object of the invention is the provision of a selective fire trigger mechanism adapted to be retrofit to all existing M-16 rifles.

Yet another object of the invention is the provision of a replacement selective fire trigger mechanism which leaves unaltered all existing selective firearms functions.

Still another object of the invention is the provision of a selective fire trigger mechanism adapted only for use with weapons already possessing full automatic fire capability.

A primary advantage of the invention is its simplicity and ease of manufacture.

Another advantage of the invention is its ease of installation under field conditions.

Yet another advantage of the invention is its ammunition conservation capability.

Still another advantage of the invention is its rapid selection of firing mode without extended lever manipulations.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and disadvantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings:

FIG. 1(*b*) shows a prior art trigger mechanism in the semi-automatic mode;

FIG. 1(*c*) shows a prior art trigger mechanism in the full automatic mode;

DESCRIPTION OF THE PREFERRED EMBODIMENTS

(BEST MODES FOR CARRYING OUT THE INVENTION)

Figure 1A:
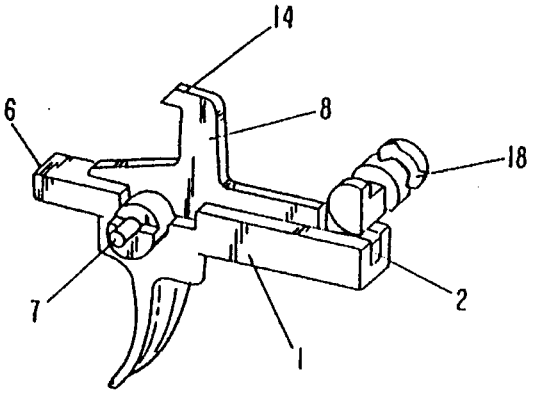
FIG-1a (PRIOR ART)
FIG. 1(*a*) shows a prior art trigger mechanism in the safe mode.
Figure 1B:
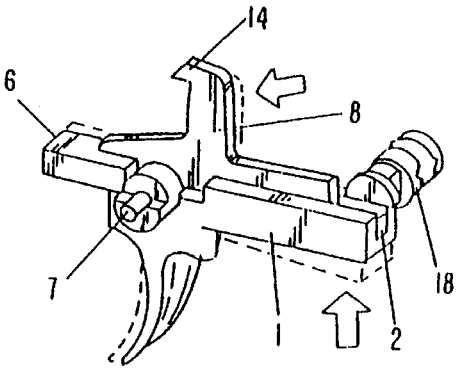
FIG-1b (PRIOR ART)
Figure 1C:
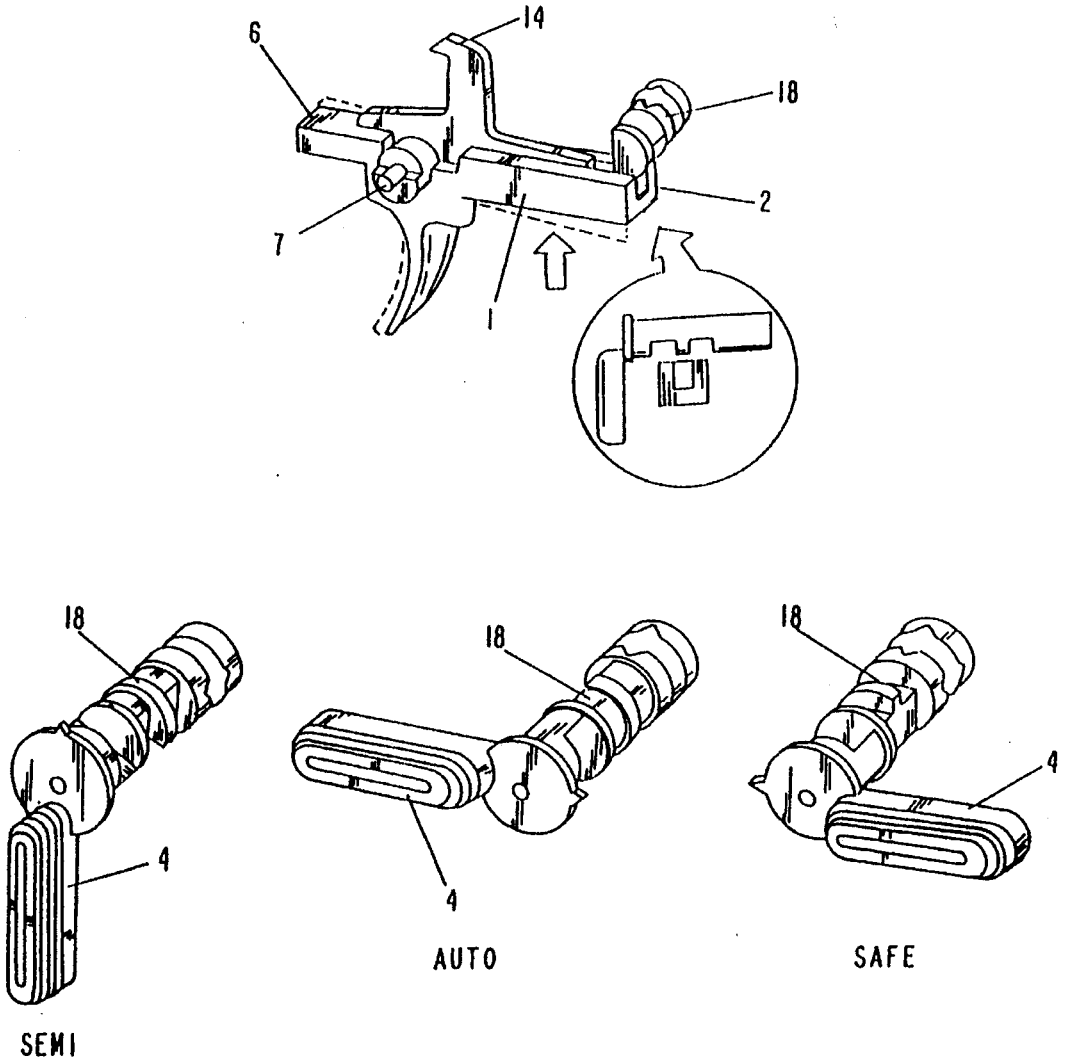
FIG-1c (PRIOR ART)

In conventional M-16 rifles, moving selector lever 4 to the SAFE position, as shown in FIG. 1(*a*), rotates selector lever cams 18 to a trigger blocking position, thereby preventing hammer release and subsequent firing of the weapon.

Figure 2:
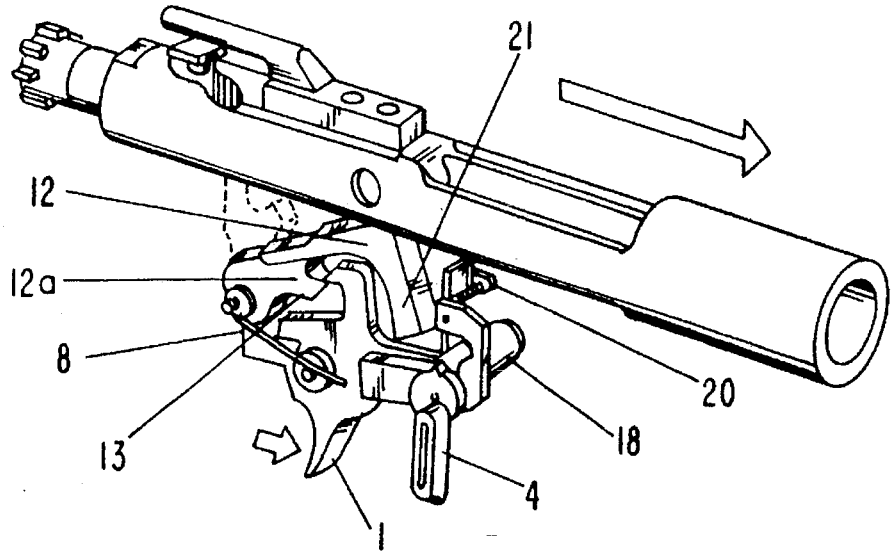
FIG – 2 (PRIOR ART)
FIG. 2 shows prior art cocking of an M-16 rifle in the semi-automatic mode with trigger held back.
Figure 3:
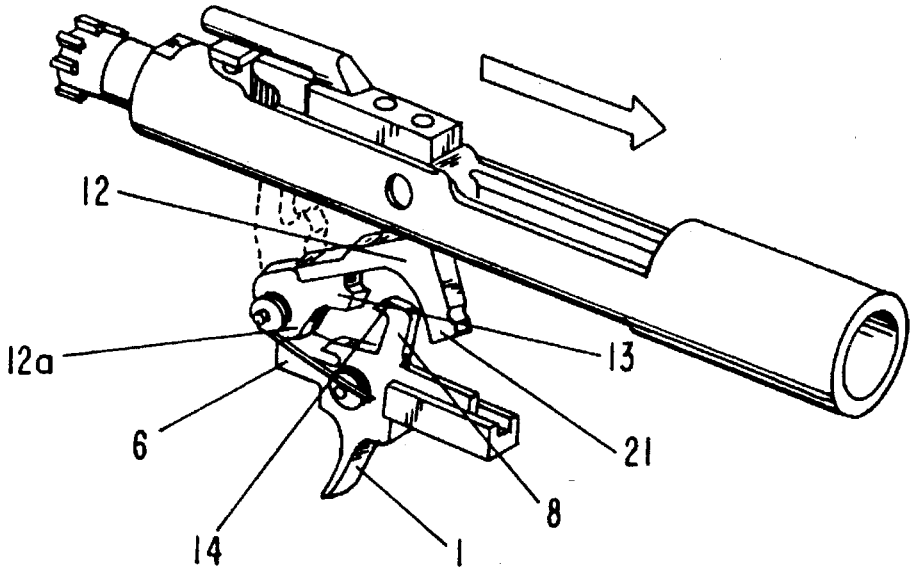
FIG – 3 (PRIOR ART)
FIG. 3 shows prior art cocking of an M-16 rifle in the semi-automatic mode with trigger released.
Figure 4:
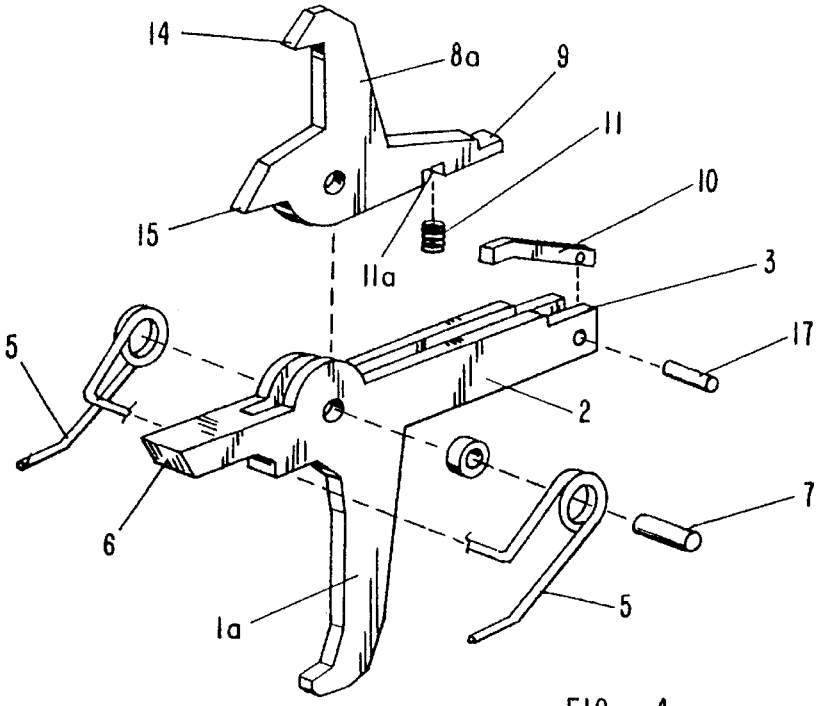
FIG. 4 is an articulated view of the selective fire trigger mechanism of the present invention.

Moving selector lever 4 to the SEMI position rotates cams 18 out of contact with both trigger 1 and disconnector 8, as shown in FIG. 1(*b*), enabling free movement of both components. The SEMI setting provides the semi-automatic mode of fire in M-16 rifles; that is, one round is fired for each separate trigger pull. Briefly, in this mode of fire, as best shown in FIGS. 1, 2 and 3, pulling the trigger disengages trigger nose 6 from bottom hammer notch 12*a* enabling hammer 12 to strike the firing pin, firing the cartridge and initiating the semi-automatic fire cycle. Gas pressure unlocks the bolt (and bolt carrier), moving them to the rear, thereby extracting and ejecting the spent cartridge, and cocking the hammer 12.

As shown in FIG. 2, in the cocking function, middle hammer hook 13 first engages disconnector hook 14 after being cammed downwardly by the bolt and bolt carrier, preventing automatic fire while the trigger 1 is still held back. Release of trigger 1 again engages trigger nose 6 and lower hammer notch 12*a*, and the weapon is cocked.

Further rearward movement of the bolt and bolt carrier clears the magazine, and a fresh round is spring-forced upwardly. Expansion of the compressed action spring now forces the bolt carrier forward, stripping the fresh round from the magazine. The new round is fed into the chamber by the bolt and bolt carrier, locking of the bolt occurs and the weapon is again ready to fire and repeat the semi-automatic cycle.

Moving selector lever 4 to the AUTO position enables the weapon to fire in the full automatic mode. In this selector setting as shown in FIG. 1(*c*), cam 18 depresses the rear end of disconnector 8 downwardly, effectively eliminating its function in this cycle of fire. In the AUTO mode of full automatic fire, hammer 12 is controlled solely by trigger nose 6 and auto sear 20. Auto sear 20, shown in FIGS. 2, 5 and 6–10, engages upper hammer hook 21 until struck by the bolt carrier moving forwardly, thereby releasing hammer 12 and causing the weapon to fire automatically. Releasing trigger 1 causes trigger nose 6 to reengage lower hammer notch 12*a*, thereby ending the full automatic cycle.

The M-16A2 rifle replaces the AUTO selector portion with BURST, and provides a modified disconnector coacting with a ratchet to limit automatic fire to three rounds.

In the preferred embodiment of the invention operable only in AUTO mode (the SAFE and SEMI settings remaining undeterred), both trigger and disconnector are modified, as best shown in FIGS. 4–10. For example, trigger 1*a* has recess 3 milled into the rear thereof, and transfer link 10 is rotatably installed on pivot roll pin 17. Disconnector 8*a* is modified by shortening and machining disconnector extension 9 at the rear thereof.

Figure 5:
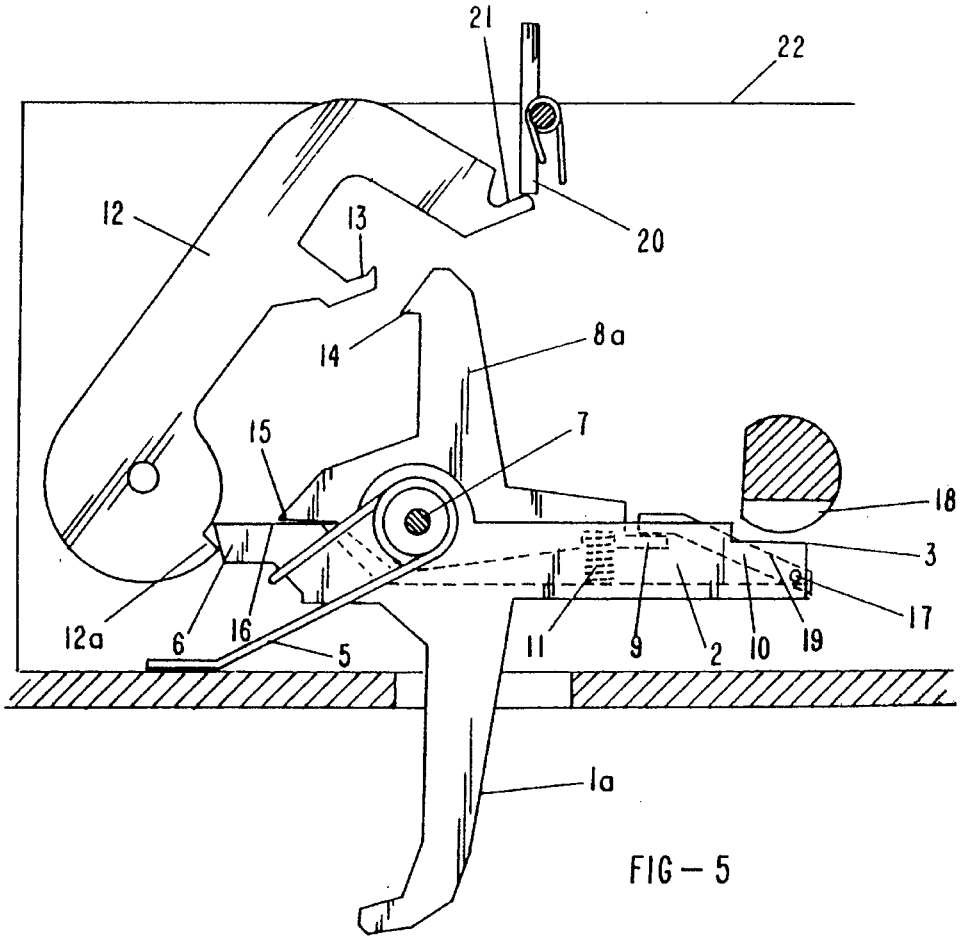
FIG. 5 is a cross-section view of the present invention retrofit in an M-16 rifle.

As shown assembled in FIG. 5 with cam 18 in the AUTO mode, the preferred embodiment of the invention comprises improved trigger 1*a* mounted for rotation about trigger pivot pin 7, and spring-loaded by trigger spring 5. Trigger 1*a* also includes trigger nose 6, trigger recess 3, and central longitudinal slot 2 extending substantially the length of the trigger. Transfer link 10 is rotatably mounted on pivot pin 17 at the rear of trigger 1. The distal, non-pivotable end of transfer link 10 engages disconnector extension 9.

Improved disconnector 8*a* is also rotatably mounted on trigger pin 7 within longitudinal slot 2 and is spring-loaded by disconnector spring 11 mounted in disconnector recess 11*a*. Disconnector 8*a* also comprises hook 14, disconnector nose 15, and disconnector extension 9.

Although the selector lever is set in the AUTO mode, the preferred embodiment of the invention permits semi-automatic operation. The present invention permits semi-automatic operation in the AUTO mode by virtue of modified disconnector 8*a*. Pulling the trigger 1*a* no farther than its median portion enables disconnector 8*a* to perform its function: modified disconnector 8*a* is not engaged by selector cam 18, hence is fully operable to perform its hammer engagement function as if the selector lever were positioned in the SEMI position.

Should full automatic fire be desired, however, trigger 1*a* need only be pulled to its extreme rearward position. The rear of trigger 1*a* will pivot upwardly until transfer link 10 engages selector cam 18. The distal end of transfer link 10 thereupon pivots downwardly, exerting a downward force on disconnector extension 9. Disconnector 8*a* is thereby pivoted rearwardly preventing engagement with the hammer 12 and middle hammer hook 13. Auto sear 20 engages upper hammer hook 21 until struck by the forwardly moving bolt carrier, thereby releasing hammer 12 to fire another round automatically. Automatic fire continues until trigger 1 is fully released, enabling lower hammer notch 12*a* to re-engage trigger nose 6, ending the cycle.

Figure 6:
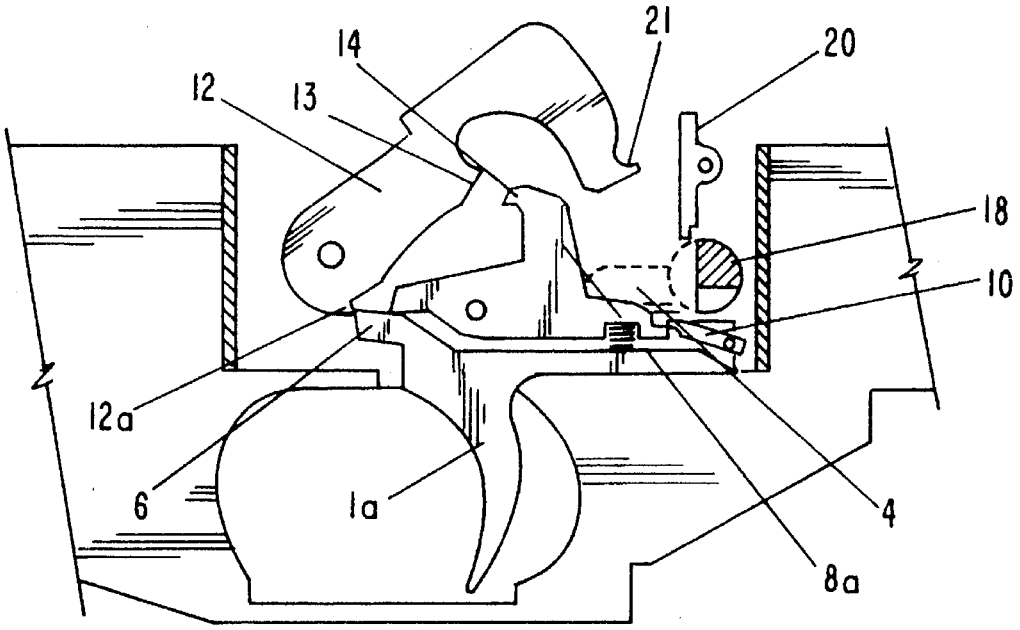
FIGS. 6–10 show the present invention in semi-automatic and full automatic cycle sequence.

FIGS. 6–10 sequentially illustrate operation of the preferred embodiment of the invention. FIG. 6 shows the invention with selector lever in the AUTO setting. The weapon is ready to fire in a semi-automatic or full automatic mode, depending upon trigger pull. Lower hammer notch 12*a* is engaged with trigger nose 6.

Figure 7:
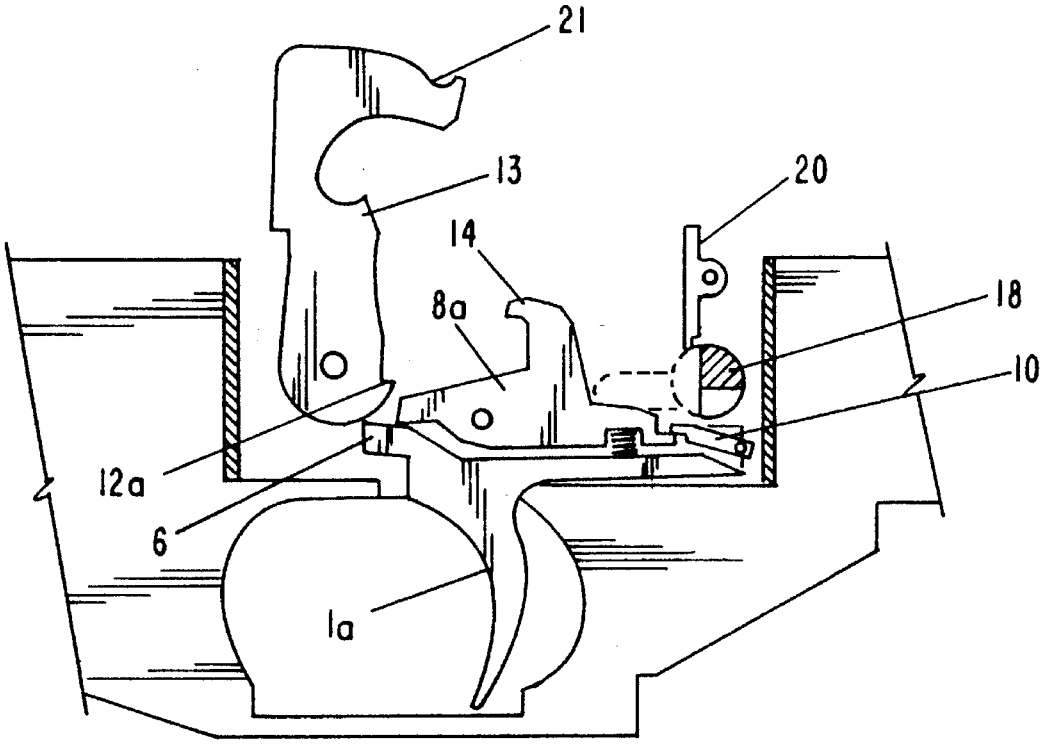

FIG. 7 shows the invention after firing. Hammer 12 is released, striking the firing pin and initiating either the semi-automatic or full automatic mode of fire. As illustrated, however, the trigger position is in the median position, indicating selection of semi-automatic fire.

Figure 8:
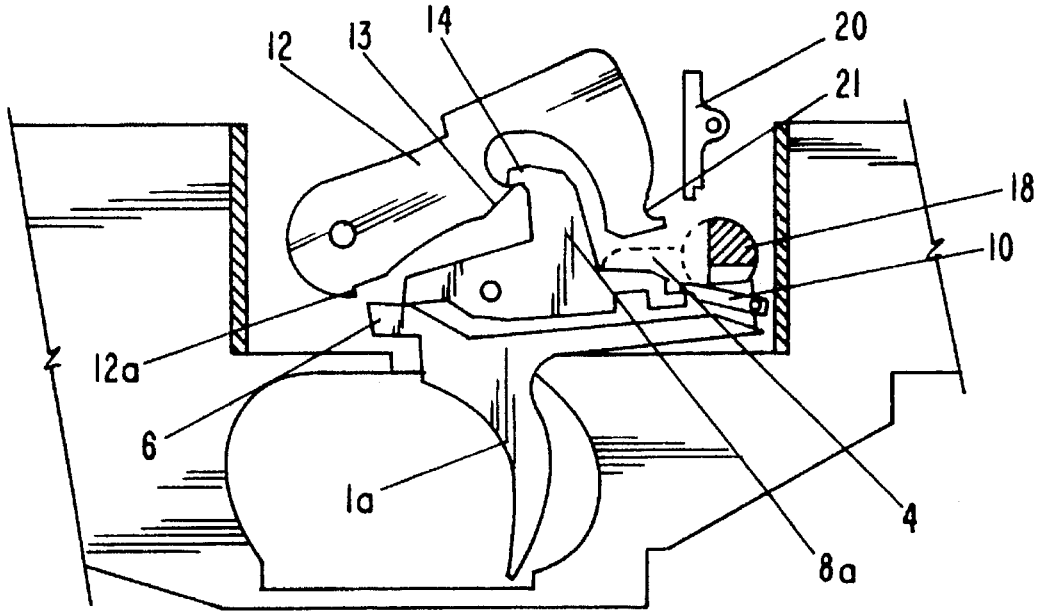

FIG. 8 illustrates cocking of the hammer in the semi-automatic mode. The middle hammer hook engages the disconnector hook so long as the trigger is held. Upon release of the trigger, trigger nose 6 will again engage lower hammer notch 12*a*.

Figure 9:
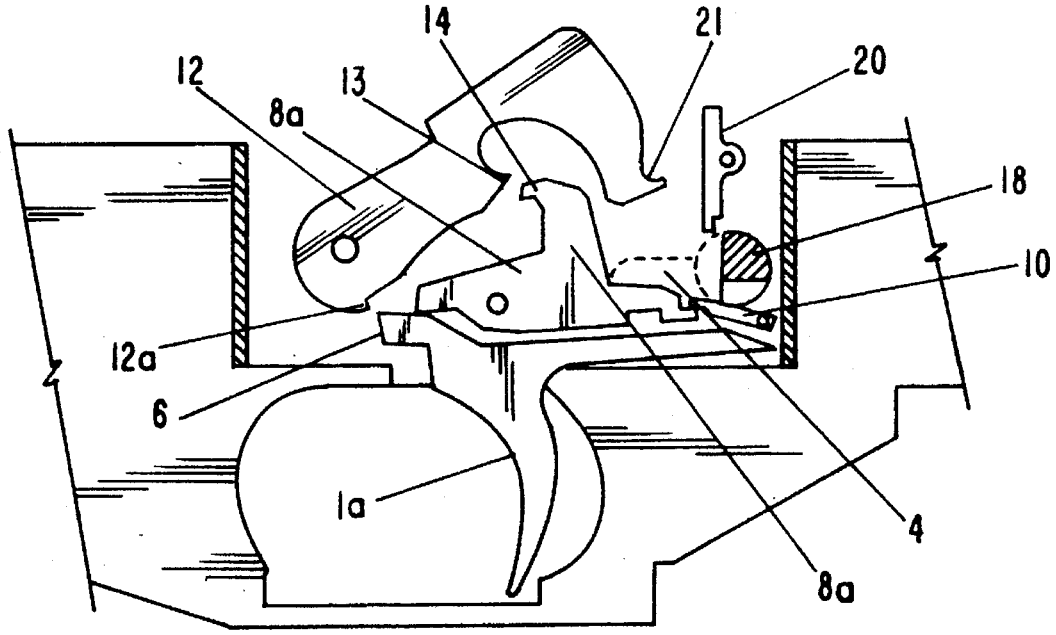
Figure 10:
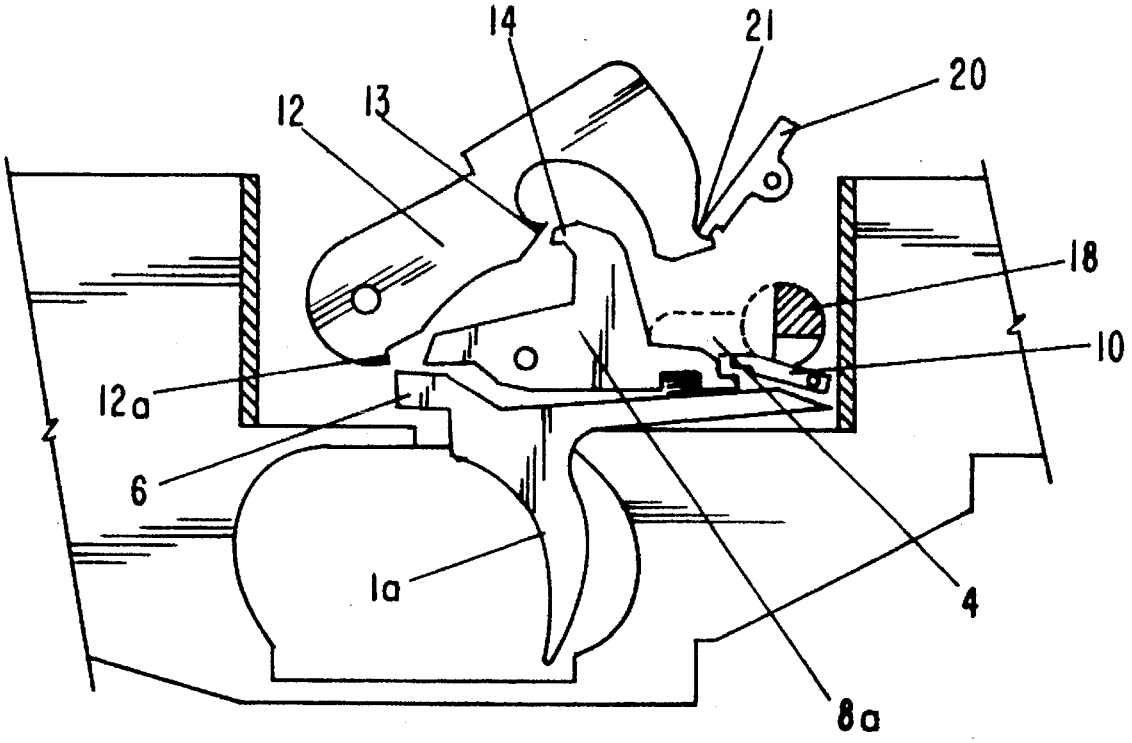

FIG. 9 shows the weapon in full automatic mode. Trigger 1*a* has been pulled further rearwardly, resulting in transfer link 10 contacting and pivoting about selector cam 18. The distal end of transfer link 10 bears down upon disconnector extension 9, exerting a downward force and rotating disconnector 8*a* in a clockwise direction. Disconnector 8*a* cannot now engage hammer 12; instead auto sear 20 engages upper hammer hook 21, momentarily as shown in FIG. 10, until the forwardly moving bolt carrier strikes auto sear 20, disengaging auto sear 20 and upper hammer hook 21 subsequently feeding, chambering, locking and firing a new round automatically.

While the invention has been disclosed for use with M-16 rifles, those ordinarily skilled in the art will recognize that the invention can be used with other weapons possessing a full automatic rate of fire.

Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A selective fire trigger apparatus for a selective fire weapon comprising:

selective fire cam means, said cam means set at full automatic fire mode;

hammer means;

trigger means for engaging and releasing said hammer means, said trigger means comprising a recess at a rear end thereof;

link means pivotably mounted within said recess; and rotatable disconnector means for engaging and releasing said hammer means, said rotatable disconnector means comprising an extension at a rear thereof, said link means engaging said extension;

wherein application of a first predetermined pressure on said trigger means enables engagement of said disconnector means and said hammer means, thus enabling semi-automatic fire; and wherein application of a second predetermined pressure on said trigger means disables engagement of said disconnector means, thus enabling full automatic fire.

2. The apparatus of claim 1 wherein said second predetermined pressure is greater than said first predetermined pressure.

3. The apparatus of claim 1 wherein application of said second predetermined pressure cams said link means about said cam means downwardly against said extension, thereby rotating and disabling said disconnector means, enabling full automatic fire.

4. The apparatus of claim 1 wherein said selective fire trigger mechanism comprises a modified standard trigger mechanism for an M-16 rifle.

5. The apparatus of claim 1 wherein said selective fire trigger mechanism is retrofitable into a standard M-16 rifle.

* * * * *